US006042530A

United States Patent [19]

Bohn et al.

[11] Patent Number: 6,042,530

[45] Date of Patent: Mar. 28, 2000

[54] DEVICE FOR PROCESSING PLY MATERIAL OR THE LIKE

[75] Inventors: Martin Bohn, Reutlingen; Wolfgang Scheller, Oberpleichfeld, both of Germany

[73] Assignee: bielomatik Leuze GmbH & Co., Germany

[21] Appl. No.: 08/892,819

[22] Filed: Jul. 15, 1997

[30] Foreign Application Priority Data

Aug. 9, 1996 [DE] Germany ..... 196 32 178

[51] Int. Cl.[7] ..... B31B 3/36

[52] U.S. Cl. ..... 493/436; 493/440

[58] Field of Search ..... 493/178, 179, 493/248, 438, 439, 440, 23, 8, 9, 10, 24, 34, 30, 446–448, 475, 478, 476, 436

[56] References Cited

U.S. PATENT DOCUMENTS

| | | | |
|---|---|---|---|
| 2,589,944 | 3/1952 | Labombarde | 493/179 |
| 2,962,733 | 12/1960 | Kramer et al. | 493/438 X |
| 3,296,986 | 1/1967 | Gansl | 493/440 X |
| 4,741,728 | 5/1988 | Bakx | 493/178 X |

FOREIGN PATENT DOCUMENTS

| | | |
|---|---|---|
| 2 645 796 | 10/1990 | France . |
| 44 13 008 | 4/1994 | Germany . |

*Primary Examiner*—David A. Scherbel
*Assistant Examiner*—Anthony Ojini
*Attorney, Agent, or Firm*—Quarles & Brady

[57] ABSTRACT

A tool (8) of a folding device (1) for edge tabs (5) of a material web (2) comprises a conveyance path (19) having a folding surface area (13) for said edge tabs (5) and a further, separate conveyance path (18) for wider edge tabs (4) intended not to be folded at said folding surface area (13). The tool (8) distinguishes the edge tabs (4, 5) by their width and steers the wider edge tabs (4) downwards out of the way prior to attaining the processing conveyance path (19).

21 Claims, 1 Drawing Sheet

DEVICE FOR PROCESSING PLY MATERIAL OR THE LIKE

TECHNICAL FIELD AND BACKGROUND OF THE INVENTION

The invention relates to a device with which material, paper or the like can be processed by it being moved relative to a processing zone in the direction of conveyance, it thereby being maintained in engagement in the processing zone with the processing means, for example, a tool unit of one or more tools. Engagement occurs at longitudinal sections of the material to be processed, located parallel to the conveying direction and simultaneously coming into engagement with the tool unit e.g. over its full width.

For corresponding work items of the cited material, which instead of paper may also be a plastics material or the like, there is a need not to subject a further longitudinal section downstream or upstream of the longitudinal section to be processed to processing or treatment in the processing zone, but to maintain it out of processing engagement with the processing zone despite it being on the fly. For this purpose the tool unit or processing zone could be partly or fully moved out of the movement path of the further longitudinal section and then returned to its working position for processing the second longitudinal section following. The direction of movement could be at right angles transversely and/or parallel to the conveying plane or at right angles transversely to the conveying direction. If the tool unit or processing zone is formed by two tools cooperating opposite each other on both sides of the material or simultaneously then the tools can be moved away from each other for the passage of the further longitudinal section to increase the "daylight" of the fly gap defined thereby, this necessitating, however, a complicated design and means of control.

In the case of an edge section of the material, this edge section intended as a longitudinal section to be processed by being transversely upswept or folded in the processing zone, a further edge strip may be provided adjacently in the longitudinal direction which is not folded and thus is not to be brought into engagement with the folding surface area(s) forming the folding zone. For a bag to be formed from the material the folded edge strips of a first bag wall serve e.g. for securing the latter to the inner side of the opposite second bag wall, whilst the non-folded edge strip protrudes as a tab or as a tear-off check tab beyond one side of the finished bag to which it is connected by a point designed to fracture. The folding or bonding tabs may be provided on the first bag wall only and the unfolded tab only on the second bag wall. As regards further details, such as features and effects of both this workpiece and the device reference is made to the German patent 44 13 008 incorporated in the instant application.

OBJECTS OF THE INVENTION

An object of the invention is to provide a device for processing layer material or the like which avoids the drawbacks of known embodiments or of the kind as described and which more particularly makes it simply possible to bring sections of the material following each other in the same lane in or out of engagement with the processing zone as desired.

SUMMARY OF THE INVENTION

In accordance with the invention control means are provided to cause the further longitudinal section, i.e. the longitudinal section not be processed, to bypass the processing zone via a bypass path, more particularly without the processing zone or the tool surface areas forming this processing zone needing to be changed in their relative position. In the case of bendingly flexible or pliantly elastic material the further longitudinal section can be caused to bypass the processing zone via a bypass path parallel to the conveying plane, as viewed in section, this bypass path being located transversely offset to the conveying plane relative to the processing zone or all surface areas forming the latter, but adjoining these surface areas at an angle directly by a practically sharp edge. This may also prove expedient in the case of a processing action penetrating the material. In the case of a processing action not penetrating the material, such as a fold, the bypass path may continually return to the conveying plane of the adjacent longitudinal section, whilst the surface area for processing initially translates into a conveying plane at right angles transversely thereto, this conveying plane adjoining in the direction of conveyance a further processing zone in which the section to be processed is folded totally on the inner side of the laterally juxtaposed section of the material.

On the fly through the device or the portion of the processing zone the material is tensioned constantly over the full corresponding length and width of the adjacent or middle longitudinal section, conveyor means provided spaced away from the device or processing zone upstream and downstream thereof engaging the material, these conveyor means permitting the tension to be smoothly changed or regulated on the fly. The material may be conveyed as a web full-length from a storage, such as a reel, and prior to attaining the device provided by stamping cuts or the like with edge-located longitudinal sections as well as printed in a further station in the region of of inkers, after which it is supplied to the device for folding. Downstream of the device and downstream of the associated conveyor means the material is processed by a processing action transversely to the conveying direction and parallel to the conveying plane or material plane, e.g. cross-cutting into individual sheet plies in sequence, each of which may then be cross-folded to form a bag.

To sense in what way the section of the material in each case is to be guided, sensing or detecting means are expediently provided, capable of operating without contact and/or contacting the material web like a sensor. The sensing means may interact only with the material sections to be processed or only with the further material sections so that these means direct only the latter via the bypass path and supply the material sections to be processed to the processing zone.

To attain this effect it is feasible to provide a movable member actuated separately from the sensing unit, as a kind of switchpoint, this member supplying each material section to the processing zone in one position and to the bypass path in the other position. Preferably, however, the sensing member simultaneously forms the switchpoint member as a kind of switchpoint operating with no movable parts which on the basis of a distinguishing feature of the material sections supply the latter to the conveyance path in each case. One such distinguishing feature may be the surface structure, the surface size, the length, the contour of the edge, the width or the like of the material sections. If the material section not to be processed protrudes at least in part laterally beyond the section of the material to be processed, it may be sensed by this protruding part prior to attaining the inlet to the processing zone and swivably moved away from this inlet transversely to the conveying plane, it already being in the bypass path on attaining this inlet.

The switchpoint forms expediently a parting paddle oriented contrary to the conveying direction and to the adjacent or middle section of the material, the thickness of the parting paddle increasing in or transversely to the conveying direction initially wedge-shaped and being defined by the cited sharp edge on which the transition zone runs between the edge sections and the adjacent section of the material. This transition or folding zone may be located for both or for all edge sections in a common straight line parallel to the conveying direction and may be formed in each edge section by a reduction in cross-section such as a groove embossment, a perforation or the like. In the case of the edge section not to be processed it is expedient to provide a perforation, and in the region of the edge section to be processed to provide a groove embossment, although this edge section may also be folded without any previous reduction in cross-section.

The tool unit forming the processing zone or the tool engaging the material for one-sided processing thereof is configured expediently inherently rigid and/or in one part, it thereby possibly forming at the same time the control means, the sensing means, the switchpoint and both conveyance paths as a whole, e.g. solely by upper or sliding surface areas for the edge sections or the adjacent section of the material. During operation this tool may be arranged fixed to a base or frame of the device, so that it itself does not need to execute any controlling movements.

These and further features are also evident from the description and the drawings, each of the individual features being achieved by themselves or severally in the form of subcombinations in one embodiment of the invention and in other fields and may represent advantageous aspects as well as being patentable in their own right, for which protection is sought in the present.

BRIEF DESCRIPTION OF THE DRAWINGS

Example embodiments of the invention are explained in more detail in the following and illustrated in the drawings in which.

DETAILED DESCRIPTION

Figures 1, 2, 3, 4:
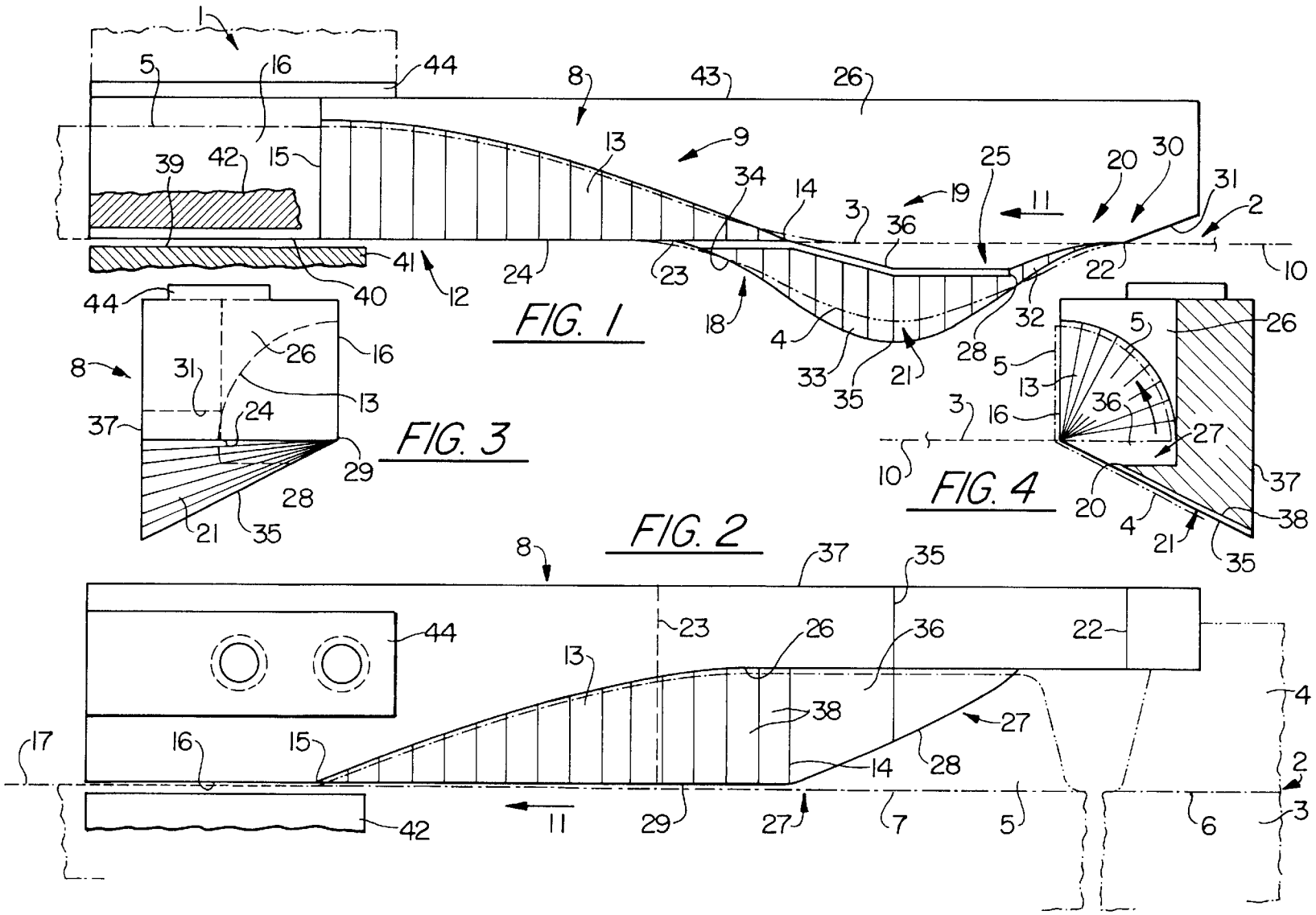
FIG. 1 illustrates a section of a device in accordance with the invention in a side view against the inner side parallel to the conveying plane and at right angles to the conveying direction.
FIG. 2 is a plan view of the arrangement as shown in FIG. 1.
FIG. 3 shows part of the arrangement as shown in FIG. 1 as viewed for the left-hand end.
FIG. 4 is a cross-section through the arrangement as shown in FIG. 1 in the region of the vertex of the bypass path.

The device 1 serves to process two-dimensional material 2 of maximally 500 g, 300 g or 200 g weight per square meter which is supplied to the device as an elongated web alternatingly 3 or more times differing in width. The web forms a middle or widest section of the material 3 constant in width throughout, provided with an integrally interconnected sequence of longitudinal sections 4, 5 as edge sections. The material sections 4, 5 are located in sequence with a section which is smaller as compared to its length, whereby adjacent to each end of each elongated section 4, 5 in the section of the material 3 after being processed in the device 1 a crossfold is required to produce a bag. The section 4 adjoins the section 3 via a transition or folding zone 6 and the section 5 via a like zone 7 in line throughout with the zone 6. Sections 4, 5 may be provided on both sides of the section 3 and each connected thereto via a corresponding zone 6 or 7. Like sections 4, 5 are processed identically on both sides in the same section of the zone by a mirror inverse arrangement of like processing means or tools 8. In the region of the section 4 the material 2 is wider than in the region of the section 5 and between the sections 4, 5 the material 2 is narrower than in the region of the sections 4, 5 between which the side edge of the material 2 is formed by those of the section 3 and which may be in line with the zones 6, 7. The sections 5 are processed in a processing zone 9 and the sections 4 guided so that they are unable to gain access to the region of this zone 9, they instead bypassing it directly adjacent to zone 9.

The material 2 including the sections 3 to 7 is supplied in a horizontal conveying plane 10 to the units 1, 8 in its longitudinal or conveying direction 11, at least the sections 4, 5 coming into contact or sliding engagement with the tool unit 12 which may comprise a single tool guiding the corresponding section 3 to 4 on one side only or several tools guiding the corresponding section 3 to 5 on both sides. For the section 5 the one-part tool 8 comprises a sliding and processing surface area 13 upswept in the direction 11 from the plane 10, the section 5 sliding on this surface area for processing only by its underside and as a result of which is upswept on the fly progressively over its length. At the inlet 14 the surface area 13 is located in the plane 10 and at the outlet 15 at right angles to the plane 10 in the corresponding conveying plane 17 in which also the zones 6, 7 are located. In the direction of conveyance 11 the outlet 15 is a continuation of the flat supporting or sliding surface area 16 of the tool 8, this surface area standing in the plane 17. As shown in FIG. 1 the sections 4, 5 are guided on the fly in sequence on separate conveyance paths located on both sides of the plane 10, namely section 4 on a conveying or bypass path 18 located only below the plane 10 and section 5 on a conveyance path comprising the surface area 13 located only above the plane 10.

For optional deflection to the two conveyance paths 18, 19 control means 20 are provided on the tool 8 with which they are integrally and positionally located configured. The control means 20 comprise a control surface area 21 sensing sections 4 only and not the sections 5, together with an inlet 22 and an outlet 23 on which the section 4 slides by its inner side facing the conveyance path 19 and which, as of the inlet 22, returns the section 4 back to the plane 10 from the plane 10 at an angle of less than 45° or 35° away from as well as towards the outlet 23. This outlet 23 is a continuation of the flat supporting and sliding surface area 24 of the tool 8, this surface area being located in the plane 10 and also extending beyond the continuation 16. The width of the surface area 21 or 13 may be slightly larger than the width of the corresponding section 4, 5 whilst both surface areas 13, 21 may be equal in length. The outlet 23 is located downstream of the inlet 14 and upstream of the outlet 15, whilst the inlet 22 is provided upstream spaced away from the surface area ends 14, 15 with a spacing which is greater than that between the surface area ends 14, 23. The spacing between the ends 14, 23 is smaller than the length of the surface area 13 or 21 or half thereof.

The control means 20 form a switchpoint 25 protruding as a protuberance 27 or parting paddle or wedge beyond an inner surface area 26 of the tool 8, this inner surface area protruding cross-sectionally full-length at right angles transversely to the plane 10 and parallel to the plane 17 only beyond the surface area 13 and the paddle 27 transversely to the plane 10 as well as opposite to the direction 11 beyond the paddle 27 and past the inlet 22. From the inlet end of the tool 8 up to the inlet 14 the surface area 26 is parallel to the plane 17 and in the same plane as the direction 11, after which this surface area is curved continually concave in approaching the outlet 15 and translating into the surface area 16 in a transition edge at an obtuse angle. This transition edge has a constant flanking angle over the width of the surface area 13 up to the surface area 24.

At its inlet end the paddle 27 is defined by an edge 28 adjoining, spaced away from the inlet 22 by a spacing corresponding to the width of the surface area 13, the surface area 26 before approaching the plane 17 at first more so and then less so, the greater the spacing from the surface area 26 as of the aforementioned adjoining point in the direction 11. Parallel to the plane 10 or opposite to the direction 11 the parting edge 28 may be slightly inclined away from the plane 10 and translates in the direction 11 into edge 29 parallel thereto, this edge 29 being located in the planes 10, 17 and flanked throughout by the surface areas 13, 16, 24. The surface areas 16, 24 are a smooth continuation up to the front edge of the tool 8. The edge 28 may be located, as shown in FIG. 2, at an acute angle to the surface area 26 and at an obtuse angle to the edge 29, it translating at the inlet 14 tangentially into the edge 29.

Like the switchpoint 25 the control means 20 also form complete sensing means 30 for sensing the different sections 4, 5. On the side of the plane 10 facing away from the conveyor lane 18 upstream of the inlet 22 the tool 8 comprise s a flat catchment surface area 31 slantingly approaching the plane 10 at an acute angle for the edge strip of the section 4 that laterally protrudes beyond the longitudinal edge of the section 5 in the same plane. The surface area 31 located cross sectionally over its full length parallel to the plane 10 adjoins the inlet 22 directly by an obtuse angled edge. Faces 21, 24 and 31 provide running faces for guiding and deflecting the first length section 4.

In the direction 11 adjoining the inlet 22 is a concave surface area part 32 of the control surface area 21 as shown in FIG. 1, this surface area part being at least as long as the surface area 21, extending only as far as the connection of the edge 28 to the surface area 26 and which cross-sectionally may be inclined in the direction 11 continually increasing at an angle to the plane 10 of max. 40° outwardly away for the latter so that it has the shape of a hollow cone. Adjoining the leading surface area 32 is a convex surface area 33 which cross-sectionally is inclined continually increasing relative to the plane 10 only up to the vertex 35 of the latter, this inclination then reducing thereafter. Accordingly, the inverse surface area 33 may have the shape of truncated cone, it translating in the direction 11 into a mirror-inverse surface area part 34 in turn concave relative to the surface area 32, this surface area part comprising cross-sectionally in the direction 11 a diminishing inclination until it locates the outlet 23 in the plane 10. This connecting surface area 34 too, may have the shape of a hollow cone. Each of the surface areas 32, 34, equal in length, is shorter than the surface area 33, having the same thickness but less curved than the vertex 35. The surface areas 32 to 34 are a smooth continuation up to the side or surface area 37 of the tool 8 facing away from the means 20, 30. Over the length of the tool 8 this surface area 37 is located parallel to the direction 11 and to the plane 17 and is formed by the same land of the tool 8 as the surface area 26.

Between the inlet end of the tool 8 and the connection of the edge 28 to the surface area 26 the surface areas 31, 32 are constant in width throughout. As of this connection the width of the surface area 21, 33 increases up to the connection to the plane 17 at an angle which is at least as large as the angle of the surface area part of the surface area 26 slantingly adjoining the outlet 15 relative to the plane 17. In the region of the edge 28 the parting wedge 27 may be flanked practically in parallel, the flanking angle of which may increase in the direction 11 as well as transversely thereto and parallel to the plane 10 outwardly in the direction to the surface area 26. Spaced away between the ends of the edge 28 or in the middle thereof the flanking side of the protuberance 27 belonging to the conveyance path 19 translates at an obtuse angle into a ramp surface area 36 slantingly approximating the plane 10 at an acute angle, this ramp surface area beginning roughly in the region of the vertex 35 on the side of the plane 10 belonging to the conveyor lane 18 and translating into the surface area 13 continuously by its end at the inlet 14. The inlet 22 is located in the conveying plane 10, the surface area 32 departing from the plane 10 at an angle in the direction 11 and the ramp 36 including the paddle flank adjacently upstream is located spaced away from plane 10 which is at the least or at the most the same as the largest spacing of the surface area 31 from the plane 10. The length of the ramp 36 corresponds to the length of the surface area 31, 32 or 34 or is substantially smaller than the length of the surface area 13 or 21 or is half, a third or a quarter thereof. The spacing between the ends 14, 23 may correspond to this length.

On conveyance of the material 2 in the direction 11 relative to the tool 8 permanently fixed in portion the sections 5 are always out of contact with the surface areas 31 to 34 and 24 so that these sections first come into contact with the tool at the ramp 36 and are then progressively also upswept from the plane 10 into the plane 17 over their length as of the surface area 13 even when they execute oscillations transversely to the zone 7 prior to attaining the ramp 36. The sections 4 which may execute oscillations about the zone 6 have already experienced tool contact earlier at the surface area 31 or at the inlet 22 or the surface area 32 at the latest and are lengthwise progressively curved in opposite directions in keeping with the shaping of the surface area 21 as described, until they are again guided flat as of the outlet 23 at the surface area 24. In this arrangement each of the two sections 4, 5 is guided directly adjoining the corresponding zone 6, 7 over the majority of the width or full width by sliding action and are maintained flat cross-sectionally throughout. The departure from the tool 8 thus takes place in the plane 10 for the sections 4 and in the plane 17 for the sections 5.

The surface area 13 or 21 and, where applicable, also the surface area 36 may be formed by a series of humps or blebs protruding merely by a few tenths or hundredths of a millimeter and spaced away from each other by a spacing of less than 10 mm, 5 mm or 2 mm. These blebs may run in parallel over the full width of the associated surface area. Furthermore, they may also be provided on the surface areas 16, 24 which, however, are expediently configured smooth. The blebs are formed by groove-like depressions 38 dish-shaped in cross-section, the bottom surface areas of which flank the rounded blebs at an obtuse angle only a few degrees smaller than 180°.

Each of the surface areas 13, 16, 24, 31 to 34 and 36 may oppose a counter surface area in forming a gap for the fly of the associated section of the material 2, this counter surface area extending in each case over part or all of the width or length of the associated surface area of the tool 8. The "daylight" of the fly gap 40 may be 2 or 4 times the thickness of the associated section 3 to 5 at the most and is expediently maximally two to three tenths of a millimeter greater than this material thickness. The daylight of the gap is constant over the major portion of the extent of the counter surface area 39. The counter surface area 39 too, may also be provided with slide blebs corresponding to those of the surface areas 13, 21. The counter surface area 39 may be formed, separately from the tool 8, by a body or a tool 41, 42 which is adjustable for infinitely varying the daylight relative to the body 8, but which is defined in operation relative to the body 8 by tensioning. In FIG. 1 the tool 41 forms with the surface area 24 the gap 40 and in FIG. 2 the tool 42 forms together with the surface area 16 a further gap. The counter surface area 39 is located in each case parallel to the corresponding gap surface area of the body 8.

On one side, more particularly on the upper side 43, the tool 8 comprises a member 44 for securing to the base of the device, this member being infinitely slidingly guidable advantageously with the tool 8 transversely to the direction 11 and parallel to the plane 10 relative to the frame of the device as a slider with gliding guidance. The flat surface area 43 parallel to the plane 10 is located on the side of the plane 10 facing the surface area 13 with a minimum spacing away from the surface area 13 smaller than the width of the surface area 12 or half thereof. Protruding beyond the surface area 43 is the fastening member 44 for engaging a depression in the base. The member 44 is located only at the downstream end of the tool 8 in the region of the surface area 16 so that the tool 8 may freely protrude in operation by the major part of its length parallel to the direction 11 or opposite to the direction 11 to permit facilitated visual inspection of processing of the material 2. In the direction 11, directly adjacent to the surface area 16, is the inlet of the tool for finish-folding the sections 5 via which the surface area 24 passes. The zone 9 may commence at the inlet 28, 36 or 14 and end at the outlet 15 or at the downstream end of the surface area 16.

It will be appreciated that all effects and properties may be provided precisely or merely roughly or substantially as described or in a major departure therefrom.

What is claimed is:

1. A device for processing layer material having first and second length sections along a common length strip of the layer material and extending from one edge of the layer material, said length sections spaced from one another along said one edge, said device comprising:

a conveyor track for receiving and conveying the layer material and defining a conveying plane and a conveying direction oriented substantially parallel to the common length strip;

processing means for workingly engaging the second length section in a working zone of said conveyor track, said processing means adjacent said conveyor track; and, control means for bypassing the first length section past said working zone by diverging the first length sections with respect to said conveying plane, thereby the first length section remaining substantially unengaged by said working zone and connected with the second length section via the layer material.

2. The device according to claim 1, wherein said control means bends the second length section with respect to the first length section while simultaneously keeping the first and second length sections interconnected via the layer material.

3. The device according to claim 2, wherein said control means include a running face separate from said working zone, said running face deflecting the first length section with respect to said conveying plane past and spaced away from said working zone.

4. The device according to claim 3, wherein said working zone includes a deflecting face for folding the second length section while the layer material is conveyed, said deflecting face being varyingly inclined with respect to said conveying plane and rising substantially from said conveying plane, said deflecting face including a downstream end for releasing the second length section at an angle with respect to said conveying plane and for further conveying the second length section downstream at said angle.

5. The device according to claim 3, wherein said running face has varying width extensions, when seen in plan view on said conveying place said width extensions increasing in said conveying direction, said running face traversing said conveying plane.

6. The device according to claim 1, wherein said control means include a shunt for opposingly deflecting the first and second length sections with respect to said conveying plane while remaining interconnected in the layer material.

7. The device according to claim 1, wherein said control means include an inherently stiff control body having remote running faces for separately guiding and spacing the first and second length sections with respect to said conveying plane when at least one of the first and second length sections enters one of said remote running faces.

8. A device for processing layer material having first and second length sections along a common length strip of the layer material and extending from one edge of the layer material, said length sections spaced from one another along said one edge, said device comprising:

a conveyor track for receiving and conveying the layer material and defining a conveying plane and a conveying direction oriented substantially parallel to the common length strip;

processing means for workingly engaging the second length section in a working zone of said conveyor track, said processing means adjacent said conveyor track; and, control means for bypassing the first length section past said working zone by diverging the first length sections with respect to said conveying plane, thereby the first length section remaining substantially unengaged by said working zone and connected with the second length section via the layer material, wherein said control means bends the second length section with respect to the first length section while simultaneously keeping the first and second length sections interconnected via the layer material, and wherein said control means include a running face separate from said working zone, said running face deflecting the first length section with respect to said conveying plane past and spaced away from said working zone, said device further defining a reference plane oriented substantially parallel to said conveying plane, wherein said reference plane defines a first side and a second plane side remote from said first plane side, said running face being located on said first plane side and said working zone being located on said second plane side.

9. A device for processing layer material having first and second length sections along a common length strip of the layer material and extending from one edge of the layer material, said length sections spaced from one another along said one edge, said device comprising:

a conveyor track for receiving and conveying the layer material and defining a conveying plane and a conveying direction oriented substantially parallel to the common length strip;

processing means for workingly engaging the second length section in a working zone of said conveyor track, said processing means adjacent said conveyor track;

control means for bypassing the first length section past said working zone by diverging the first length sections with respect to said conveying plane, thereby the first length section remaining substantially unengaged by said working zone and connected with the second length section via the layer material; and, sensing means for separately detecting said first length section and said second length section and for controlling said control means, said control means controlling motion of the first and second length sections along separate conveying paths including a bypass path and a working path.

10. The device according to claim 9, wherein said sensing means are provided to measure by contacting at least one of the first and second length sections and to alternately guide the first length section on said bypass path while subsequently guiding the second length section on the working path mechanically.

11. The device according to claim 10, wherein said sensing means are provided to contact substantially only the first length section and not the second length section.

12. A device for processing layer material having first and second length sections along a common length strip of the layer material and extending from one edge of the layer material, said length sections spaced from one another along said one edge, said device comprising:

a conveyor track for receiving and conveying the layer material and defining a conveying plane and a conveying direction oriented substantially parallel to the common length strip;

processing means for workingly engaging the second length section in a working zone of said conveyor track, said processing means adjacent said conveyor track;

control means for bypassing the first length section past said working zone by diverging the first length sections with respect to said conveying plane, thereby the first length section remaining substantially unengaged by said working zone and connected with the second length section via the layer material; and, said conveyor track including a track length section, wherein within said track length section said control means include separate first and second conveying paths including a bypass path for guiding the fist length section and a working path for guiding the second length section, said first length section to overlapping said second length section parallel to said conveying direction.

13. A device for processing layer material having first and second length sections along a common length strip of the layer material and extending from one edge of the layer material, said length sections spaced from one another along said one edge, said device comprising:

a conveyor track for receiving and conveying the layer material and defining a conveying plane and a conveying direction oriented substantially parallel to the common length strip;

processing means for workingly engaging the second length section in a working zone of said conveyor track, said processing means adjacent said conveyor track;

control means for bypassing the first length section past said working zone by diverging the first length sections with respect to said conveying plane, thereby the first length section remaining substantially unengaged by said working zone and connected with the second length section via the layer material; and, said control means include a first running face for guiding the first length section and a second running face for guiding the second length section, said first running face being separate from said second running face, said first and second running faces including upstream ends including a first upstream end and a second upstream end, said first and second running faces including downstream ends including a first downstream end and a second downstream end, said upstream and said downstream ends being oriented at angles with respect to said conveying plane, at least one of said upstream ends and said downstream ends being displaced with respect to each other transverse to said conveying direction and substantially parallel to said conveying plane.

14. The device according to claim 13, wherein said first and second upstream ends converge in said conveying direction, from said first upstream end said first running face continuing concavely between said first upstream end and said first downstream end said first running face being convex when seen parallel to said conveying plane and transverse to said conveying direction.

15. The device according to claim 13, wherein said first upstream end includes an upstream face section increasing in width extension substantially at said second upstream end.

16. The device according to claim 13, wherein said first downstream end directly connects to a first continuation face, said second downstream end directly connecting to a second continuation face, at least one of said first and second continuation faces being substantially planar for planarly guiding the associated length section.

17. A device for processing layer material having first and second length sections along a common length strip of the layer material and extending from one edge of the layer material, said length sections spaced from one another along said one edge, said device comprising:

a conveyor track for receiving and conveying the layer material and defining a conveying plane and a conveying direction oriented substantially parallel to the common length strip;

processing means for workingly engaging the second length section in a working zone of said conveyor track, said processing means adjacent said conveyor track; and, control means for bypassing the first length section past said working zone by diverging the first length sections with respect to said conveying plane, thereby the first length section remaining substantially unengaged by said working zone and connected with the second length section via the layer material, said control means include remote running faces including a first running face for guiding the first length section and a second running face for guiding the second length section separate from the first length section, in cross-section transverse to said conveying direction and in side view said running faces bounding taper wedges.

18. The device according to claim 17, wherein at least one of said taper wedges defines varying wedge angles along said conveyor track.

19. A device for processing layer material having first and second length sections along a common length strip of the layer material and extending from one edge of the layer material, said length sections spaced from one another along said one edge, said device comprising:

a conveyor track for receiving and conveying the layer material and defining a conveying plane and a conveying direction oriented substantially parallel to the common length strip;

processing means for workingly engaging the second length section in a working zone of said conveyor track, said processing means adjacent said conveyor track: and, control means for bypassing the first length section past said working zone by diverging the first length sections with respect to said conveying plane, thereby the first length section remaining substantially unengaged by said working zone and connected with the second length section via the layer material, the first length section being broader than the second length section, said control means including remote first and second running faces for separately guiding the first and second length section respectively, said first running face rearwardly laterally projecting over said second running face.

20. A device for processing layer material having first and second length sections along a common length strip of the layer material and extending from one edge of the layer material, said length sections spaced from one another along said one edge, said device comprising:

a conveyor track for receiving and conveying the layer material and defining a conveying plane and a conveying direction oriented substantially parallel to the common length strip;

processing means for workingly engaging the second length section in a working zone of said conveyor track, said processing means adjacent said conveyor track; and, control means for bypassing the first length section past said working zone by diverging the first length sections with respect to said conveying plane, thereby the first length section remaining substantially unengaged by said working zone and connected with the second length section via the layer material, in said conveying direction, said control means continue into a first continuation face for guiding the first length section and into a second continuation face for guiding the second length section substantially at right angles with respect to the first length section.

21. A device for processing layer material having first and second length sections along a common length strip of the layer material and extending from one edge of the layer material, said length sections spaced from one another along said one edge, said device comprising:

a conveyor track for receiving and conveying the layer material and defining a conveying plane and a conveying direction oriented substantially parallel to the common length strip;

processing means for workingly engaging the second length section in a working zone of said conveyor track, said processing means adjacent said conveyor track;

control means for bypassing the first length section past said working zone, thereby the first length section remaining substantially unengaged by said working zone and connected with the second section via the layer material, and a tool body made in one part, wherein said tool body includes said processing means, said working zone and said control means.

* * * * *